US005867123A

United States Patent [19]

Geyh et al.

[11] Patent Number: 5,867,123

[45] Date of Patent: Feb. 2, 1999

[54] PHASED ARRAY RADIO FREQUENCY (RF) BUILT-IN-TEST EQUIPMENT (BITE) APPARATUS AND METHOD OF OPERATION THEREFOR

[75] Inventors: Edward Geyh, Groton; Thomas Y. Sikina, Acton; Tariq R. Adhami, Bellingham; Jack J. Schuss, Newton, all of Mass.

[73] Assignee: Motorola, Inc., Schaumburg, Ill.

[21] Appl. No.: 878,511

[22] Filed: Jun. 19, 1997

[51] Int. Cl.[6] ..... H01Q 3/22; H01Q 3/24; H01Q 3/26

[52] U.S. Cl. ..... 342/372; 342/173; 342/174

[58] Field of Search ..... 342/372, 373, 342/173, 174

[56] References Cited

U.S. PATENT DOCUMENTS 5,038,146 8/1991 Troychak et al. ..... 342/173
5,086,302 2/1992 Miller ..... 342/373
5,122,806 6/1992 Julian ..... 342/173
5,253,188 10/1993 Lee et al. ..... 364/571.02
5,592,178 1/1997 Chang et al. ..... 342/372

*Primary Examiner*—Theodore M. Blum
*Attorney, Agent, or Firm*—Frank J. Bogacz

[57] ABSTRACT

Failure detection in a phased array antenna system is accomplished using a cluster-oriented detection scheme and a mutual coupling test signal injection technique. RF BITE TRM (110) is connected to an RF BITE port (120) on an illuminating means (140). Illuminating means (140) provides a uniform input signal level to many TRMs (150). Each TRM (150) is connected to an antenna element (210). Controller (170) causes one element (220) in a cluster to operate in a transmit mode and causes other elements (230) to operate in a receive mode. Internal detectors in TRMs (150) are used to detect signal levels, and these detected signal levels are used to identify failure modes. This cluster search method operates well for many types of phased arrays including rectangular and triangular lattices, planar and conformal apertures, single frequency and shared aperture types.

20 Claims, 2 Drawing Sheets

PHASED ARRAY RADIO FREQUENCY (RF) BUILT-IN-TEST EQUIPMENT (BITE) APPARATUS AND METHOD OF OPERATION THEREFOR

FIELD OF THE INVENTION

This invention relates generally to phased array antennas and, more particularly, to apparatus and methods for identifying failures in a phased array antenna.

BACKGROUND OF THE INVENTION

Space-based communication systems are being designed and deployed by a number of different organizations. Space-based systems provide unique opportunities and problems because of the space environment. One problem is test and failure identification. This problem is particularly important to antennas because there is not usually a great deal of redundancy included in the antennas due to the size limitations.

Phased array antennas have been used extensively on-board satellites. Prior art systems have included extra hardware to perform on-orbit testing of the phased array antennas. This leads to increased launch costs and decreased payload functionality.

A significant need exists for apparatus and methods for providing more efficient testing and failure identification within a particular satellite antenna system. In addition, there is a significant need for apparatus and methods for increasing the utilization of the on-board resources of orbiting satellites through small modifications to the test strategies.

BRIEF DESCRIPTION OF THE DRAWINGS

A more complete understanding of the present invention can be derived by referring to the detailed description and claims when considered in connection with the figures, wherein like reference numbers refer to similar items throughout the figures, and:

DETAILED DESCRIPTION OF A PREFERRED EMBODIMENT

Figure 1:
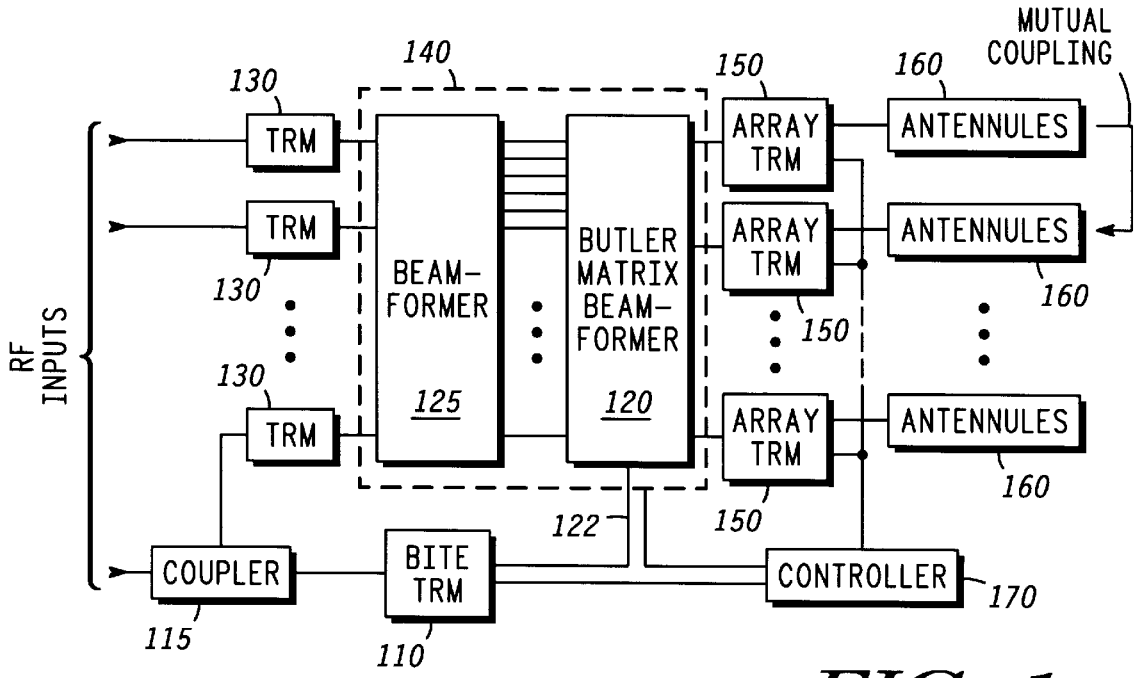
FIG. 1 shows a simplified block diagram of an RF system within which failures in a phased array antenna can be determined in accordance with a preferred embodiment of the present invention.

The method and apparatus of the present invention provides for more efficient testing and failure identification by using a self contained radio frequency (RF) monitor in a phased array antenna. In addition, the present invention provides an apparatus and method for increasing the utilization of the on-board resources of orbiting satellites through small modifications to the test strategies. These small modifications involve advantageously using the mutual coupling that exists between the antenna elements in a phased array antenna.

Many previously used RF Built-In-Test-Equipment (BITE) schemes use an external receiver, in combination with an external source of radiation, such as a calibration antenna and a synthesized oscillator. In the apparatus and method disclosed herein, the RF BITE hardware and process are unique in that an internal detector is used as the RF BITE sensor in each transmit/receive module (TRM), and that a cluster-based mutual coupling mechanism is used to introduce the RF BITE monitoring signal and determine failures.

The apparatus and method of the present invention has been successfully developed, designed, built, and verified on a space based Main Mission Antenna (MMA) Panel. In a preferred embodiment of the present invention, the RF BITE subsystem operates in the space environment required of the MMA Panel, although the RF BITE subsystem also could be used in non-space environments.

Using internal level-detection diodes in the TRMs, the RF BITE subsystem monitors the operating status of the phased array antenna at the unit cell level, while using the hardware normally used during the antenna transmit or receive operation. A detector in the TRM is coupled to the RF signal path. This internal detector is used for determining a receive RF signal level when the TRM is operating in the receive mode, and for determining a transmit RF signal level when the TRM is operating in a transmit mode. In a preferred embodiment, the detector is coupled to the controller for reporting the receive RF signal level, and for reporting the transmit RF signal level.

In a preferred embodiment of the present invention, the RF BITE subsystem determines the location of and type of failure at the unit cell level of a phased array antenna using an internal threshold detection scheme. This involves failure detection at the array TRM, its attenuator, and phase shifter. This also involves the detection of component failures affecting the operation of the unit cell, such as the radiator, RF connections, DC or logic connections to the TRM within a single phased array antenna using internal threshold detection.

In a preferred embodiment of the present invention, the RF BITE equipment is operated using an on-board controller in order to determine array failures at the unit cell level. The phased array is composed of a multiplicity of unit cells, which when active form the transmit or receive radiation patterns, and may be used for communication purposes for the space-based system, but may also be used for radar, imaging, microwave heating or other purposes.

The unit cell is composed of a radiator TRM, RF interconnections, and generally a beamformer. The unit cell operational capabilities are assessed by RF BITE and reported to a system monitor that determines the operability and service needs for the antenna. In the absence of RF BITE, the operability of a phased array after initial alignment is not as reliable. Once failures are detected and catalogued by the RF BITE subsystem, the operational status of the array is determined as a function of the location and number of failed cells, up to the point where the failure conditions exceed operational requirements, and the MMA Panel is declared non-functional.

FIG. 1 shows a simplified block diagram of an RF system within which failures in a phased array antenna can be determined in accordance with a preferred embodiment of the present invention. In a preferred embodiment of the present invention, the system hardware needed to conduct the RF BITE sequence is based on a cluster-oriented mutual coupling scheme and an internal TRM detector. RF BITE TRM 110 is connected to one of the RF signal paths (i.e., array driver ports) by means of a directional coupler 115. This allows RF BITE TRM 110 to be active without introducing switches into the phased array antenna architecture.

RF BITE TRM 110 is also connected to RF BITE port 122 on Butler Matrix Beamformer 120. Using this port illuminates the array face TRMs in a nominally uniform manner. This is an important introduction point because using the RF BITE port on Butler Matrix Beamformer 120 allows the RF BITE routine to operate without incurring the amplitude variation associated with driver TRMs 130. Large amplitude variations (up to 25 dB) can occur in the case where a driver port is used for RF BITE. With all array face ports illuminated by Butler Matrix Beamformer 120, the method of the present invention selects transmit (TX) and receive (RX) TRM locations that carry out the RF BITE tests at the unit cell level.

Driver TRMs 130 are coupled to Butler Matrix Beamformer 120 using beamformer 125. In a preferred embodiment of the present invention, driver TRM RF BITE is conducted separately, using a separate Butler Matrix beamformer port.

Butler Matrix Beamformer 120 is coupled to TRMs 150. TRMs 150 are individual transmit/receive modules which are coupled to individual antenna elements 160.

Controller 170 is coupled to each one of TRMs 150 and to illuminating means 140. Controller 170 determines the failures in the phased array antenna. Controller 170 commands at least one TRM to operate in a receive mode, at least one TRM to operate in a transmit mode, and at least one TRM to operate in a standby mode when tests are being performed. Controller 170 determines the signal level below which failures are declared. Controller 170 can calibrate the detectors used to determine failures.

Figure 2:
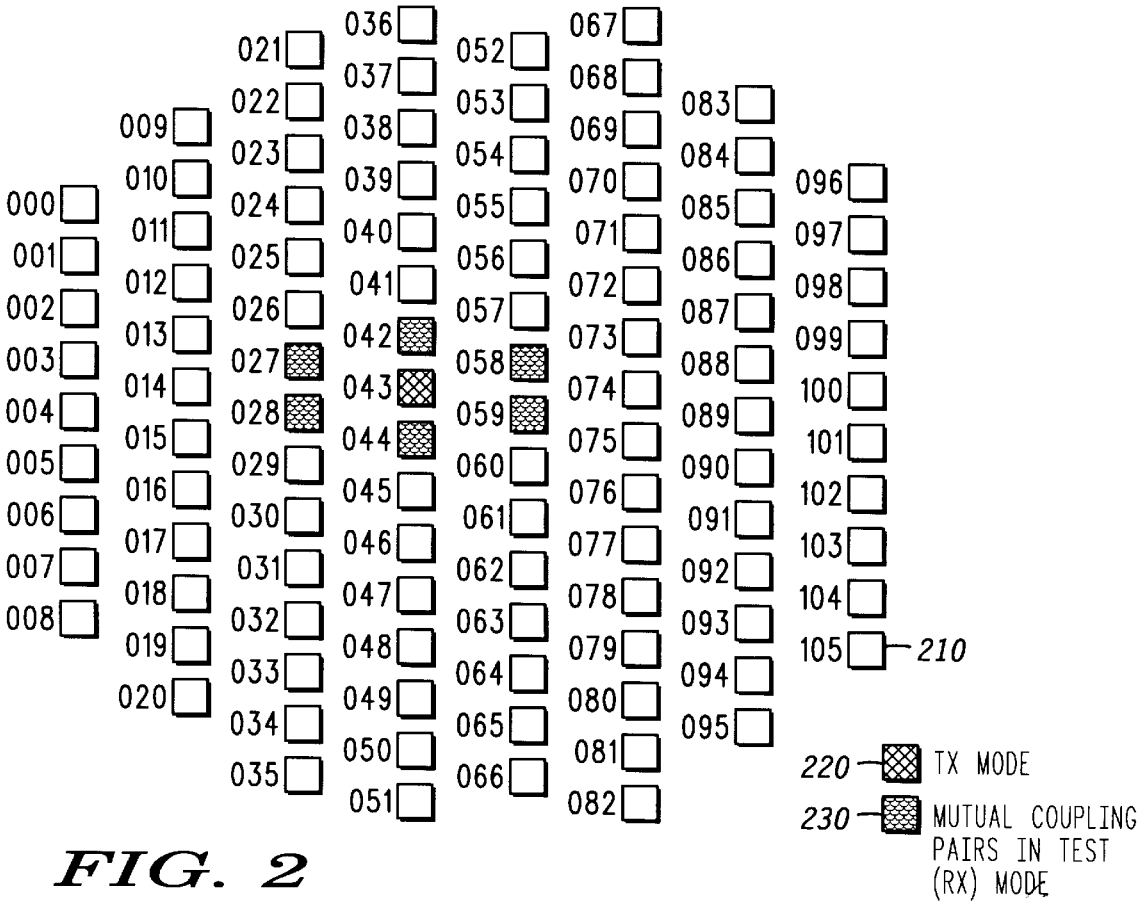
FIG. 2 shows a simplified diagram of an exemplary cluster on a phased array antenna in accordance with a preferred embodiment of the present invention.

FIG. 2 shows a simplified diagram of an exemplary cluster on a phased array antenna in accordance with a preferred embodiment of the present invention. The example phased array antenna is shown with 106 elements 210. These elements are numbered from 0 to 105. Only one TX mode element 220 (i.e., element 043) is shown for ease of understanding. Six RX mode elements 230 (i.e., elements 027, 028, 042, 044, 058, and 059) are also shown for ease of understanding. Those skilled in the art will recognize that more TX mode elements 220 could be shown, and the location of TX mode elements 220 could be different than that shown in FIG. 2. Those skilled in the art will also recognize that more or less RX mode elements 230 could be shown, and the location of RX mode elements 230 could be different than that shown in FIG. 2. In addition, the configuration and number of elements in a particular phased array antenna could differ from that shown in FIG. 2.

In a preferred embodiment of the present invention, the RF BITE tests involve the use of a selected TRM in the TX mode, and one or more adjacent TRMs in the RX mode in a mutual coupling cluster. The TRM in RX mode should be adjacent, and among a number of nearest neighbors (e.g., six as shown in FIG. 2), in order to couple enough RF power into the detector of the TRM in RX mode. In the preferred embodiment shown in FIG. 2, up to six neighbor cells are defined at the initialization stage of the RF BITE process so that primary and secondary cell mappings can be established in the event of a failed TRM in either TX or RX mode. Center element 043 and a first neighbor (e.g., element 027) are a first pair of elements used to determine unit cell operability. If this pair indicates a failure condition, center element 043 and a second neighbor (e.g., element 028) are similarly tested, as are the remaining neighbor cells (042, 044, 058 and 059) around center element 043 of the cluster selected in a sequential manner. If a failure condition is found for all neighbors, the center cell failure condition is identified and catalogued by the RF BITE controller, and processing moves to a next cluster (e.g., element 044 as a center element with neighbor elements 028, 029, 043, 045, 059, and 060).

In a preferred embodiment, the expected RF signals used in the RF BITE process are determined using prior information from mutual coupling and calibration data. To enhance the accuracy of the expected RF signal levels, a procedure to calibrate the phased array antenna is performed under a controlled environment. In this calibration procedure, the RF signal level is measured for every pair in the mutual coupling cluster over the entire array. The difference in RF signal level obtained relative to the expected level is fed back and stored in a mutual coupling table for the phased array antenna. This measurement now ensures that the expected values are accurately known for each phased array antenna.

Referring again to FIG.1, the signal advances along the RF signal path, continuing from directional coupler 115 to RF BITE TRM 110, through Butler Matrix 120, through an array face TX cell, to an array face RX cell, and its detector. The signal analysis is broken down into a maximum and minimum signal analysis. The maximum signal analysis case examines maximum gain and minimum loss phased array antenna conditions. The minimum signal analysis case examines the minimum gain, maximum loss case.

The method and apparatus of the present invention can be used to detect a number of different array element failure modes. In a preferred embodiment of the present invention, the detected RF BITE failure modes are White Out, Brown Out, Black Out, High Gain Error, Phase Shift Error, and Attenuator Error.

A TX White Out failure occurs when an array face TRM is operating in a TX mode while commanded to be in receive, standby or a non-operating mode. Likewise, an RX white out failure occurs when an array face TRM is operating in an RX mode while commanded to be in transmit, standby or a non-operating mode. With the TRM fixed in such a state, the antenna performance will be either dramatically degraded because of the noise produced in a frozen TX mode or will result in limiter damage for a frozen RX mode.

This failure mode is detected by searching the array with the first neighbor cell in RX mode and all others in standby mode. A detection indicates the TX case White Out failure mode is suspected for the center element of a given cluster. The test is repeated for all array unit cells. It is also repeated for the receive case, with the center cell in RX mode and all other cells in standby.

In a preferred embodiment of the present invention, the RF BITE routine detects White Out failures, and conducts a corrective action where TX White Out failures occur. The corrective action consists of commanding a pinch-off mode to the faulty TRM, once the routine has located it. Since an RX White Out failure has no system degradation, no corrective action needs to be taken and the element is flagged as a failure.

A Brown Out failure occurs when the RF signal received from a TRM has a low gain response when compared with previous RF BITE tests. The Brown Out detection algorithm must have the capability to discern between a low gain response on an individual TRM and a low response from the phased array antenna system, as would be the case when the RF signal was lower than expected. In a preferred embodiment, this is accomplished using a moving average of a selected reference cell as a control.

A Black Out failure is the most commonly considered failure, and it occurs when there is no RF response from a TRM in either TX or RX mode. This failure mode is detected by operating a central and first neighbor element pair. If no signal detection occurs, the central and second neighbor pair are used, up to the last neighbor. If no signal detections occur among all neighboring cells, then the central element is declared a Black Out failure. If any of the neighboring cells result in a signal detection, then the first neighbor can be tested for a Black Out failure.

A High Gain Error occurs when the response from a given TRM is significantly higher than expected. This is the converse of the Brown Out failure mode, and is processed in a similar way.

A Phase Shifter Error occurs when a phase shifter bit within a given TRM fails. This failure causes an RF signal reduction (e.g., nominally 3 dB) when the bit is commanded. It is the amplitude change corresponding to a phase bit failure that serves as the detection mechanism for the RF BITE routine.

An Attenuator Error is similar to the Phase Shifter Error, except that the failure occurs on an attenuator bit of a given TRM. The amplitude error associated with the failed bit serves as the detection mechanism for the RF BITE routine. The attenuator bits (e.g., within an 8-dB range of the calibration nominal base) are exercised and tested for failure.

In a preferred embodiment of the present invention, amplitude errors are used to detect phase shifter errors. The phase shifter evaluation is based on associated amplitude errors, so the detector used in the disclosed RF BITE process can be an amplitude detection device. This saves the additional cost and complexity associated with a phase and amplitude detector.

In a preferred embodiment of the present invention, a wide range of tested failure modes is provided. The failure modes assessed by the disclosed RF BITE method are comprehensive for phased array antennas. There are no known failure modes excluded from the RF BITE search path.

Figure 3:
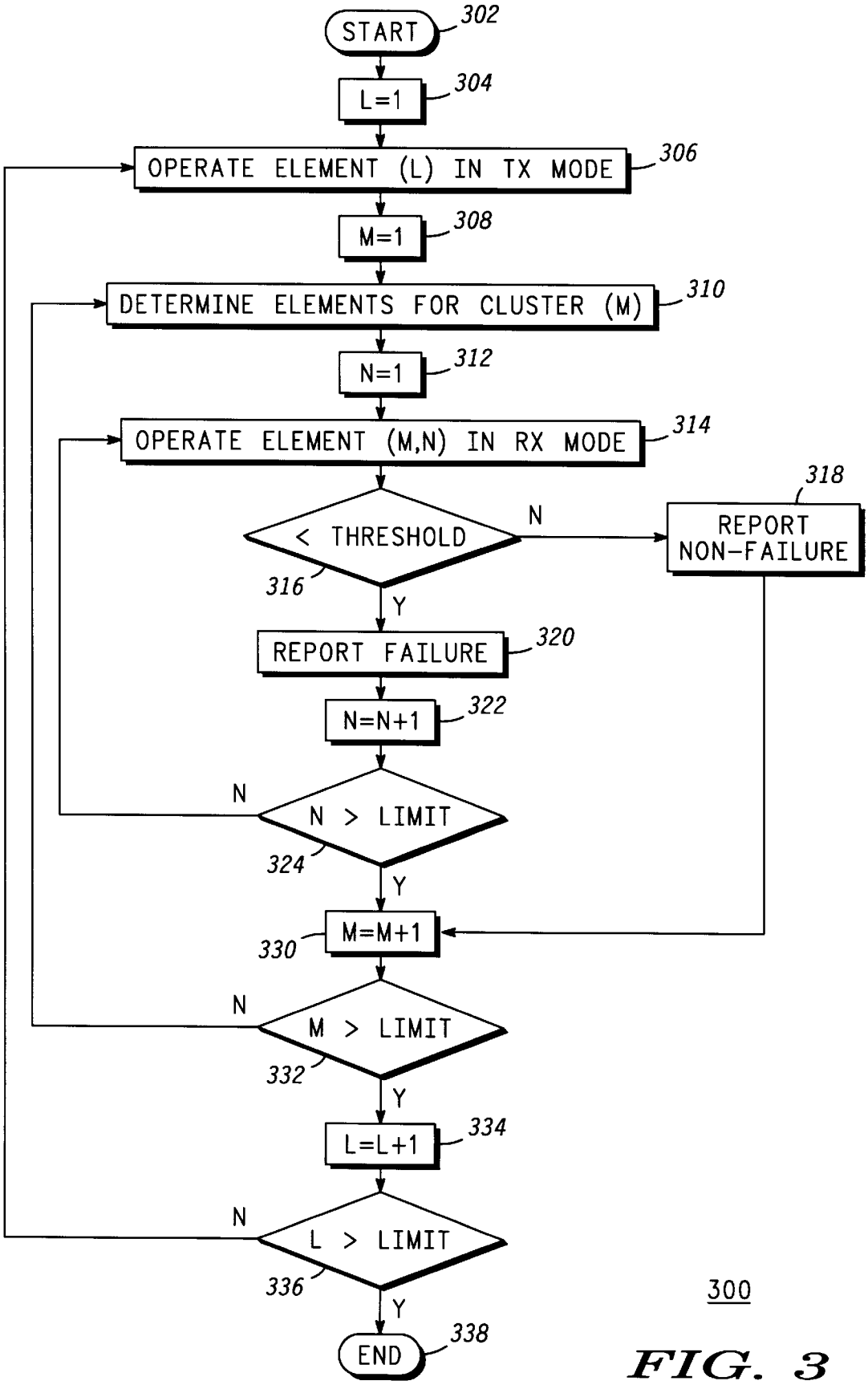
FIG. 3 shows a flow chart of a method for using a cluster search procedure to locate failures in a phased array antenna in accordance with a preferred embodiment of the present invention.

FIG. 3 shows a flow chart of a method for using a cluster search procedure to locate failures in a phased array antenna in accordance with a preferred embodiment of the present invention. Procedure 300 starts with step 302. Step 302 could be initiated, for example, as the result of a system level command.

In step 304, a counting variable (L) is established to identify which element is going to be used as the transmitting element. In this test, one element is chosen at a particular time to be the transmitting element and other elements which are close to the transmitting element are used as receiving elements.

In step 306, the L(th) element is operated in the transmit mode. This requires that the TRM coupled to this antenna element be commanded to operate in the transmit mode. The TRM receives an RF signal at its input from the beamformer.

In step 308, another counting variable (M) is established to identify which cluster configuration (cell mapping) is going to be used for this particular test. Different testing strategies require different cluster configurations. The testing of elements near the edge of the phased array antenna also require different cluster configurations. In step 310, the individual elements that are contained in the M(th) cluster configuration are identified. Those skilled in the art will recognize that one or many cluster configurations could be used to perform the testing.

In step 312, another counting variable (N) is established to identify the individual elements in a selected cluster configuration. In step 314, element (M, N) is operated in the receive mode. This antenna element is desirably adjacent to the transmitting element mentioned in step 306. Operation of element (M, N) requires that the TRM coupled to this antenna element be commanded to operate in the receive mode. The TRM has a detector which is used to determine a received signal level. The received signal is RF energy that has been received at this antenna element due to mutual coupling between adjacent antenna elements.

In step 316, the received signal level is compared to a threshold value which establishes a limit for the expected signal level. When the received signal level exceeds the threshold value, then procedure 300 branches to step 318. When the received signal level does not exceed the threshold value, then procedure 300 branches to step 320.

In step 318, a non-failure condition is reported. For this condition, both the transmitting element and receiving element used in the comparison portion of the procedure are declared to be functional. Procedure 300 then continues with step 330.

In step 320, a failure condition is reported. For this condition, both the transmitting element and receiving element used in the comparison portion of the procedure are assumed to be non-functional and further testing is performed. In step 322, counting variable (N) which is used to identify the adjacent elements in the cluster is incremented by one.

In step 324, the value for this counting variable (N) is compared with a limit. This limit is established based on the number of nearest neighbors there are for this particular transmitting element. When this counting variable does not exceed the limit, then procedure 300 branches to step 314, and procedure 300 iterates as shown in FIG.3. When this counting variable does exceed the limit, then procedure 300 branches to step 330.

In step 330, counting variable (M) which is used to identify the cluster configurations is incremented by one. In step 332, the value for this counting variable (M) is compared with a limit. This limit is established based on the number of cluster configurations there are for this particular transmitting element. When this counting variable does not exceed the limit, then procedure 300 branches to step 310, and procedure 300 iterates as shown in FIG.3. When this counting variable does exceed the limit, then procedure 300 branches to step 334.

In step 334, counting variable (L) which is used to identify the transmitting antenna element is incremented by one. In step 336, the value for this counting variable (L) is compared with a limit. This limit is established based on the number of elements to be tested and the testing strategy employed. When this counting variable does not exceed the limit, then procedure 300 branches to step 306, and procedure 300 iterates as shown in FIG. 3. When this counting variable does exceed the limit, then procedure 300 branches to step 338 and ends.

The procedure described in FIG. 3 illustrated the testing of all elements in a phased array antenna. In alternate embodiments, fewer elements could be tested using fewer than all neighboring elements. For example, a single element could be tested.

In a preferred embodiment of the present invention, the cluster search method makes use of the mutual coupling test signal injection technique while simultaneously conducting a fault search with a low probability of RF BITE failure. The cluster search method operates well for many types of phased arrays including rectangular and triangular lattices, planar and conformal apertures, single frequency, and shared aperture types among others.

In a preferred embodiment of the present invention, the use of a beamformer to distribute RF BITE signals provides a simple way to illuminate the unit cells. The use of the beamformer to distribute the RF signal used during the RF BITE tests eliminates the need for switching circuits that otherwise would be required to distribute the RF signal to the unit cell pair under test.

The apparatus and method of the present invention have several advantages that make the present invention a preferred methodology for operability assessment in a phased array antenna system.

In a preferred embodiment of the present invention, the use of internal detectors within the TRM has a major cost advantage and represents a significant simplification to the RF BITE hardware compared to previous systems that rely on an external receiver. The single external resource needed to run RF BITE is the RF source, and this also can be internalized, if needed.

In a preferred embodiment of the present invention, the use of a mutual coupling method to inject a controlled test RF signal into the unit cell under test using only the array hardware and no external antennas simplifies the overall design complexity.

One of the major advantages of the disclosed RF BITE concept is the relatively modest hardware and software resources needed for its operation. Beyond the amplitude detectors (e.g., a diode detector and level shifter) in the TRMs, there are no additional components needed to implement the process. The computational resources needed are minimal also.

The disclosed RF BITE apparatus and method are applicable to phased array antennas of virtually any type, working in any environment. So long as the phased array radiator mutual coupling amplitude is sufficient to allow detection, the method can be used successfully.

The present invention has been described above with reference to a preferred embodiment. However, those skilled in the art will recognize that changes and modifications can be made in this embodiment without departing from the scope of the present invention. For example, while a preferred embodiment has been described in terms of using a specific number of antenna elements, other antennas can be envisioned which use different numbers of elements. Also, the sequence of steps shown in FIG. 3 could be altered while achieving the same results. Accordingly, these and other changes and modifications which are obvious to those skilled in the art are intended to be included within the scope of the present invention.

What is claimed is:

1. A radio frequency (RF) Built-In-Test-Equipment (BITE) apparatus for performing failure detection for a phased array antenna, said RF BITE apparatus comprising:

a plurality of antenna elements in said phased array antenna, wherein a certain amount of mutual coupling occurs between individual pairs of antenna elements, wherein said certain amount of mutual coupling for at least one of said individual pairs of antenna elements is stored in a mutual coupling table, said mutual coupling table being established during a calibration procedure;

a plurality of transmit/receive modules (TRMs), wherein each one of said plurality of TRMs is coupled to one of said plurality of antenna elements;

an illuminating means coupled to each one of said plurality of transmit/receive modules; and a controller coupled to each one of said plurality of TRMs and to said illuminating means, said controller for detecting failure modes in said phased array antenna using a cluster search procedure, wherein said controller causes one element in a cluster of said plurality of antenna elements to operate as a transmitting element, causes one other element to operate as a receiving element, processes a detected signal level from a detector in a TRM coupled to said one other element, and uses said detected signal level to identify failure modes.

2. The RF BITE apparatus as claimed in claim 1, wherein a transmit/receive module comprises:

a detector coupled to a RF signal path for determining a receive RF signal level when said TRM is operating in a receive mode, and for determining a transmit RF signal level when said transmit/receive module is operating in a transmit mode, wherein said detector is coupled to said controller for reporting said receive RF signal level, and for reporting said transmit RF signal level.

3. The RF BITE apparatus as claimed in claim 1, wherein said illuminating means comprises:

a beamformer with multiple output ports, each of said multiple output ports being coupled to one of said plurality of TRMs;

an RF BITE transmit/receive module (RF BITE TRM) coupled to an input port on said beamformer, said input port is uniformly coupled to said multiple output ports; and a directional coupler coupled to said RF BITE TRM and coupled to an RF signal path.

4. The RF BITE apparatus as claimed in claim 1, wherein said controller is further for commanding a TRM to operate in a transmit mode when said one element coupled to said TRM operates as said transmitting element, for commanding one other TRM to operate in a receive mode when said one other element operates as said receiving element, for commanding at least one of said plurality of transmit/receive modules to operate in a standby mode, and for performing said calibration procedure.

5. The RF BITE apparatus as claimed in claim 4, wherein said controller is further for determining a White Out failure, said White Out failure occurring when a TRM is operating in said transmit mode while commanded not to be in said transmit mode or when said TRM is operating in said receive mode while commanded not to be in said receive mode.

6. The RF BITE apparatus as claimed in claim 4, wherein said controller is further for determining a Brown Out failure, said Brown Out failure occurring when an RF signal received at a TRM operating in said receive mode has a low gain response when compared with previous results.

7. The RF BITE apparatus as claimed in claim 4, wherein said controller is further for determining a Black Out failure, said Black Out failure occurring when there is no RF response from a TRM in either said transmit mode or said receive mode.

8. The RF BITE apparatus as claimed in claim 4, wherein said controller is further for determining a High Gain Error, said High Gain Error occurring when a response from a TRM operating in said receive mode is significantly higher than expected, for determining a Phase Shifter Error, said Phase Shifter Error occurring when a phase shifter bit within said TRM fails, and for determining an Attenuator Error, said Attenuator Error occurring when an attenuator bit within said TRM fails.

9. A method for operating a failure detection system in a phased array antenna wherein each one of a plurality of transmit/receive modules (TRMs) is coupled to one of a plurality of antenna elements in said phased array antenna, said method comprising the steps of:

a) commanding at least one TRM to operate in a transmit mode;

b) determining a first cluster said first cluster identifying a list of nearest neighbors from said plurality of TRMs to operate in a receive mode;

c) identifying a first TRM in said first cluster;

d) commanding said first TRM to operate in receive mode;

e) commanding other TRMs in said first cluster to operate in standby mode;

f) obtaining a first detected signal level from said first TRM, wherein said first detected signal level is a measure of radio frequency (RF) energy that has been received at said first TRM due to mutual coupling between an antenna element coupled to said first TRM and another antenna element coupled to said at least one TRM operating in said transmit mode;

g) comparing said first detected signal level with a first expected value; and h) reporting a TX White Out failure when said first detected signal level is greater than said first expected value said comparing step indicates said first TRM is operating in said transmit mode while commanded not to be in said transmit mode.

10. The method as claimed in claim 9, said method further comprising the steps of:

i) determining detected signal levels for said other TRMs;

j) comparing said detected signals with said first expected value: and k) reporting a TX White Out failure when said comparing step indicates one of said other TRMs is operating in said transmit mode while commanded not to be in said transmit mode.

11. The method as claimed in claim 10, wherein said method further comprises the steps of:

l) comparing said detected signals with a second expected value; and m) reporting a RX White Out failure when said comparing step indicates one of said other TRMs is operating in said receive mode while commanded to be in said standby mode.

12. The method as claimed in claim 11, wherein said method further comprises the step of:

n) performing corrective action when a TX White Out failure is resorted.

13. The method as claimed in claim 9, wherein said method further comprises the steps of:

g1) comparing said first detected signal level with said first expected value; and h1) reporting a Brown Out failure when said first detected signal level is significantly less than said first expected value said comparing step results indicate said first TRM has a low gain response.

14. The method as claimed in claim 9, wherein said method further comprises the steps of:

g1) comparing said first detected signal with said first expected value; and h1) reporting a High Gain Error failure when said first detected signal level is significantly more than said first expected value, said comparing step indicates said first TRM has a high gain response.

15. The method as claimed in claim 9, wherein said method further comprises the steps of:

d1) commanding a single bit to change in a phase shifter in said first TRM;

f1) obtaining said first detected signal level from said first TRM;

g1) comparing said first detected signal level with a first expected value; and h1) resorting a Phase Shift Error failure when said first detected signal level is less than said first expected value by a first amount, said comparing step indicates said a failure associated with said single bit in said phase shifter.

16. The method as claimed in claim 9, wherein said method further comprises the steps of:

d1) commanding a single bit to chance in an attenuator in said first TRM;

f1) obtaining said first detected signal level from said first TRM:

g1) comparing said first detected signal level with a first expected value; and h1) reporting an Attenuator Error failure when said first detected signal level is different than said first expected value by a first amount, said comparing step indicates said a failure associated with said single bit in said attenuator.

17. The method as claimed in claim 9, wherein said method further comprises the steps of:

i) identifying another cluster; and j) repeating steps (c–j) until all clusters have been tested.

18. A method for operating a failure detection system in a phased array antenna wherein each one of a plurality of transmit/receive modules is coupled to one of a plurality of antenna elements in said phased array antenna, said method comprising the steps of:

a) operating one of said plurality of antenna elements as a transmitting element;

b) identifying a cluster of said plurality of antenna elements as receiving elements, wherein said cluster contains antenna elements which are mutually coupled to said transmitting element;

c) obtaining a detected signal level from at least one of said receiving elements in said cluster, wherein said detected signal level is a measure of radio frequency (RF) energy that has been received at said at least one of said receiving elements due to mutual coupling with said transmitting element;

d) comparing said detected signal level with a known value, wherein said known value is determined from expected values obtained during a calibration procedure and stored in a mutual coupling table;

e) reporting a failure for a pair of antenna elements when said detected signal level is less than said known value, said pair comprising said transmitting element and said at least one of said plurality of receiving elements; and f) reporting a non-failure when said detected signal level is equal to or greater than said known value.

19. The method as claimed in claim 18, wherein said method further comprises the steps of:

g) identifying another cluster; and h) repeating steps (c–h) until all clusters associated with said transmitting element have been tested.

20. The method as claimed in claim 19, wherein said method further comprises the steps of:

i) operating another one of said plurality of antenna elements as said transmitting element; and j) repeating steps (b–j) until all of said plurality of antenna elements have been tested.

* * * * *